US005470236A

United States Patent [19]

Wissler

[11] Patent Number: 5,470,236

[45] Date of Patent: Nov. 28, 1995

[54] ROTATING JOINT FOR AERIAL LADDERS

[75] Inventor: Vernon J. Wissler, Conestoga, Pa.

[73] Assignee: Amity Machine Corp., Alburtis, Pa.

[21] Appl. No.: 199,468

[22] Filed: Feb. 22, 1994

[51] Int. Cl.[6] ..... H01R 35/00

[52] U.S. Cl. ..... 439/12; 439/22

[58] Field of Search ..... 439/12, 13, 18, 439/20–22, 27, 29

[56] References Cited

U.S. PATENT DOCUMENTS

| | | | |
|---|---|---|---|
| 2,770,475 | 11/1956 | Rafferty | 284/94 |
| 3,181,715 | 5/1965 | Olson | 439/12 X |
| 3,797,862 | 3/1974 | Letterman | 439/12 X |
| 3,905,450 | 9/1975 | Persson | 285/94 |
| 4,098,526 | 7/1978 | DuBois | 285/119 |
| 4,175,809 | 11/1979 | Dusko | 439/22 |
| 4,186,763 | 2/1980 | Ferguson | 285/136 |
| 4,487,435 | 12/1984 | Yamatani | 285/94 |
| 4,605,096 | 8/1986 | Bishop | 182/51 |
| 5,035,448 | 7/1991 | Seabrook et al. | 285/94 |

*Primary Examiner*—William Briggs
*Attorney, Agent, or Firm*—Martin Fruitman

[57] ABSTRACT

The apparatus is a rotating electrical coupling for use at the base of an aerial ladder which furnishes water, hydraulic controls and electrical lines to the top of the rotating ladder. The electrical coupling uses multiple, concentric, printed circuit type conductive bands oriented in a single plane and wiper contacts held in contact with the bands. The entire structure is located within a compartment within which can also be placed insulating liquids or gases to prevent corrosion and deterioration of the rotating electrical contacts.

5 Claims, 2 Drawing Sheets

ROTATING JOINT FOR AERIAL LADDERS

BACKGROUND OF THE INVENTION

This invention deals generally with fire escapes, ladders and scaffolds, and more generally with a rotating coupling used at the base of an aerial ladder to transfer fluids and electrical circuits to the ladder.

Aerial ladder trucks for fire fighting are no longer the simple extension ladders on trailers which are seen in old movies or as children's toys, and up which firemen once pulled conventional fire hoses. A modern aerial ladder truck has hydraulically operated ladder lifting and rotating motors, a vast number of electrical accessories permanently installed atop the ladder, and a permanent high pressure water supply pipe which is built right into the ladder tower. Furthermore, these modern aerial ladder trucks include controls located atop the ladder, so that a fireman stationed there can fully control the ladder and also control all the electrical functions available.

Such devices therefore require passing high pressure water, several hydraulic control lines, and multiple electrical connections through the rotating joint between the ladder and the support truck, and since the major focus of the rotating joint has been to transfer a large quantity of high pressure water across the rotating joint, the configuration of such rotating couplings has been largely determined by the size of the water coupling. Such couplings therefore usually are constructed with a large central pipe rotating relative to a surrounding body, with the pipe and body sealed against water leakage by the use of conventional "O" ring seals mounted within annular channels within one of the parts.

The auxiliary functions, such as the rotating hydraulic fluid couplings and the rotating electrical connectors, are then built around the large central water coupling, and extend out along the length of the axis of the water coupling. Typically, each hydraulic line rotating coupling requires an annular channel to contain hydraulic fluid and additional channels with two "O" ring seals and their associated annular channels on either side of the hydraulic channel. Since it is typical to include at least four such sets for the transfer of hydraulic lines across the rotating joint, a considerable distance along the length of the rotating coupling is used up by the hydraulic line couplings.

The transfer of electrical lines across the rotating joint also uses more of the length along the axis of the rotating coupling. Existing rotating couplings use sets of mating conductive slip rings and contacts for each wire crossing through the rotating coupling. One part of each set is attached to the rotating pipe section of the coupling and the other part is attached to the stationary body assembly. Since modern aerial ladder trucks require many electrical circuits for lighting, control, and communication, and each circuit requires several wires crossing the rotating joint, many slips rings must be stacked axially along the joint. This usually requires either that the assembly be made longer than would otherwise be required, or that the number of electrical circuits be limited.

The present invention furnishes a novel configuration for the electrical connections of a rotating coupling for an aerial ladder truck. This configuration reduces the distance along the axial length of the water coupling occupied by the rotating electrical couplings, and therefore permits many more circuits to be included within a rotating coupling without increasing its size.

SUMMARY OF THE INVENTION

The present invention uses a structure with a multiple band surface for the transfer of electrical connections across the rotating joint. The first assembly of the coupling includes several surfaces with alternating concentric bands of conductor and insulation, and each surface has independent, isolated, conducting bands on its base insulator structure. Each banded surface is in contact with a complimentary structure on the second assembly of the rotating coupling, with the structure on the second assembly of the joint supporting several wiper contacts which are held against the conducting bands on the first assembly of the coupling.

Each electrical circuit is fed to several wiper contacts physically attached to one assembly of the rotating joint, for instance the stationary assembly. The several wiper contacts are all oriented in a single plane and on a circle whose center is the axis of the rotating joint. The mating part for each individual circuit on the other part of the rotating joint, the rotating assembly, is a conductive band on a printed circuit type board which the wiper contacts ride upon as the assemblies of the joint rotate relative to each other. This conductive band is also located in a single plane and forms a circle parallel to and of the same radius as the several wiper contacts attached to the stationary assembly. Thus, the several wiper contacts are constantly held in contact with the conductive band as it rotates, and the electrical current is transferred from the wiper contacts on one assembly to the conductive band on the other assembly. The conductive band, which is fixed in position relative to the rotating assembly upon which it is mounted, is electrically connected to a wire which can then be fed to any location on the rotating portion of the aerial ladder.

Thus, one electrical circuit can be transferred across the rotating joint for every individual conductive band on each surface, and even if only two bands are used on each insulating base surface, the number of connections transferred across the rotating joint in any given axial length is doubled. However, it is quite practical to use three or more conductive bands on each surface, and with three bands the number of circuits transferred across the rotating joint for a particular axial length is trebled compared to the prior art structure. The present invention therefore provides for a virtually unlimited number of electrical connections across the rotating joint without any increase in the length of the joint.

DETAILED DESCRIPTION OF THE INVENTION

Figure 1:
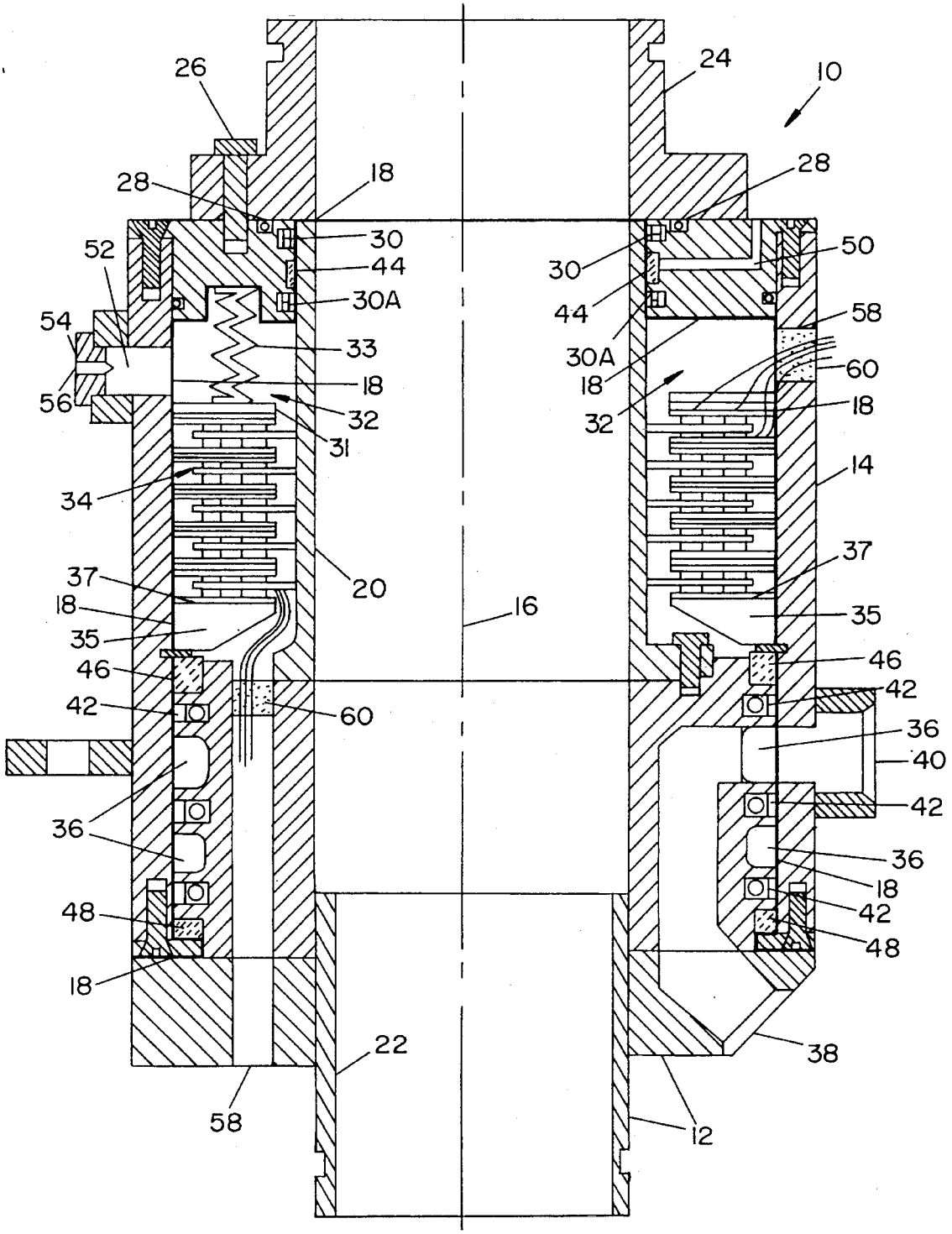
FIG. 1 is a cross section assembly view of a rotating joint of the preferred embodiment.

FIG. 1 is a cross section assembly view of the preferred embodiment of rotating joint 10 which includes stationary assembly 12 and rotating assembly 14, which are concentric on axis 16. The line of the surface of rotation and principal dividing line between stationary assembly 12 and rotating assembly 14 is indicated in FIG. 1 by heavy line 18.

Devices such as rotating joint 10 are used on aerial ladder fire trucks to convey high pressure and high volume water, hydraulic control lines, and electrical power and control to the rotating aerial ladder from the stationary vehicle upon which the aerial ladder is mounted.

Because the flow of water across rotating joint 10 must be of such high quantity, the water path is straight through the joint, with essentially no obstructions to flow. In the present invention, rotating joint 10 therefore includes stationary water pipe 20 to which is attached input hose coupling 22 for furnishing the water.

Rotating assembly 14 includes output hose coupling 24 which mates with water pipe 20 and rotates relative to it. Hose coupling 24 is held onto rotating assembly 14 by several bolts 26, only one of which is shown. The junction between output hose coupling 24 and rotating assembly 14 is sealed against water leakage by "O" ring 28. Seals 30 and 30A are used along rotating surface line 18 to prevent water leakage into annular space 32 which is located between rotating assembly 14 and the outer surface of water pipe 20. Annular space 32 is the location of rotating electrical coupling assembly 34 which will be described in detail below in reference to FIG. 2.

However, the mechanical structure holding electrical coupling assembly 34 within annular space 32 is best described in regard to FIG. 1. Since electrical coupling assembly 34 is essentially a group of wiper contacts separated by and compressed against rotating metal bands, electrical coupling assembly 34 should be compressed together in the direction parallel to axis 16 of rotating joint 10. This is accomplished by attaching several support structures 35 to the inside surface of rotating assembly 14, and attaching the lower surface 37 of electrical coupling assembly 34 to support structures 35. Several compression springs 33, only one of which is shown, are then installed to push top 31 of electrical coupling assembly 34 against support structures 35 and thus assure the application of a continuous force parallel to the axis of rotating assembly 10, so that the several layers of wiper contacts are held in continuous contact with their associated conductive bands.

The hydraulic lines are coupled across rotating joint 10 in conventional fashion by the use of hydraulic annular grooves 36 which border and open onto surface of rotation 18. As shown in FIG. 1, each such annular groove 36 has an input pipe, such as input pipe 38, opening into it from at least one location within stationary assembly 12, and rotating assembly 14 includes at least one output pipe 40 located so that it always meets and opens into annular groove 36 regardless of the position of rotation of rotating assembly 14. As is well understood in the art, each such annular groove 36 is prevented from leaking hydraulic fluid into the water or out of the assembly by cap seals 42 installed within sealing grooves which straddle the locations of hydraulic annular grooves 36 along rotating surface line 18.

Rotating joint 10 also includes several strategically located wear bands, 44, 46 and 48 to prevent wear of the metal parts along rotating surface line 18, and to furnish wear surfaces which can be easily replaced on a regular basis. Wear band 44, which is located close to seal 30, also has a small weep hole 50 leading from wear band 44 to the outside of rotating assembly 14. Thus, if any small amount of water leaks past seal 30, it will be prevented from leaking into annular chamber 32 by a second seal 30A on the other side of wear band 44, and the water will instead leak out by way of weep hole 50. Such a structure prevents small water leaks from damaging electrical coupling assembly 34.

Another feature to protect the integrity of electrical coupling assembly 34 is also shown in FIG. 1. Opening 52 in rotating assembly 14 is furnished to permit the placement into annular space 32 of a solid descant or insulating medium such as pressurized nitrogen gas or a suitable insulating oil. Plug 54 is furnished to seal off opening 52, and valve 56 within plug 54 is used to fill annular space 32 with the appropriate material if a liquid or gas is used. The only other requirement to use such a fluid to protect electrical coupling assembly 34 from deterioration is that electrical wire access holes 58 be sealed with plugs 60 to prevent leakage of the material used to protect electrical coupling assembly 34.

Figure 2:
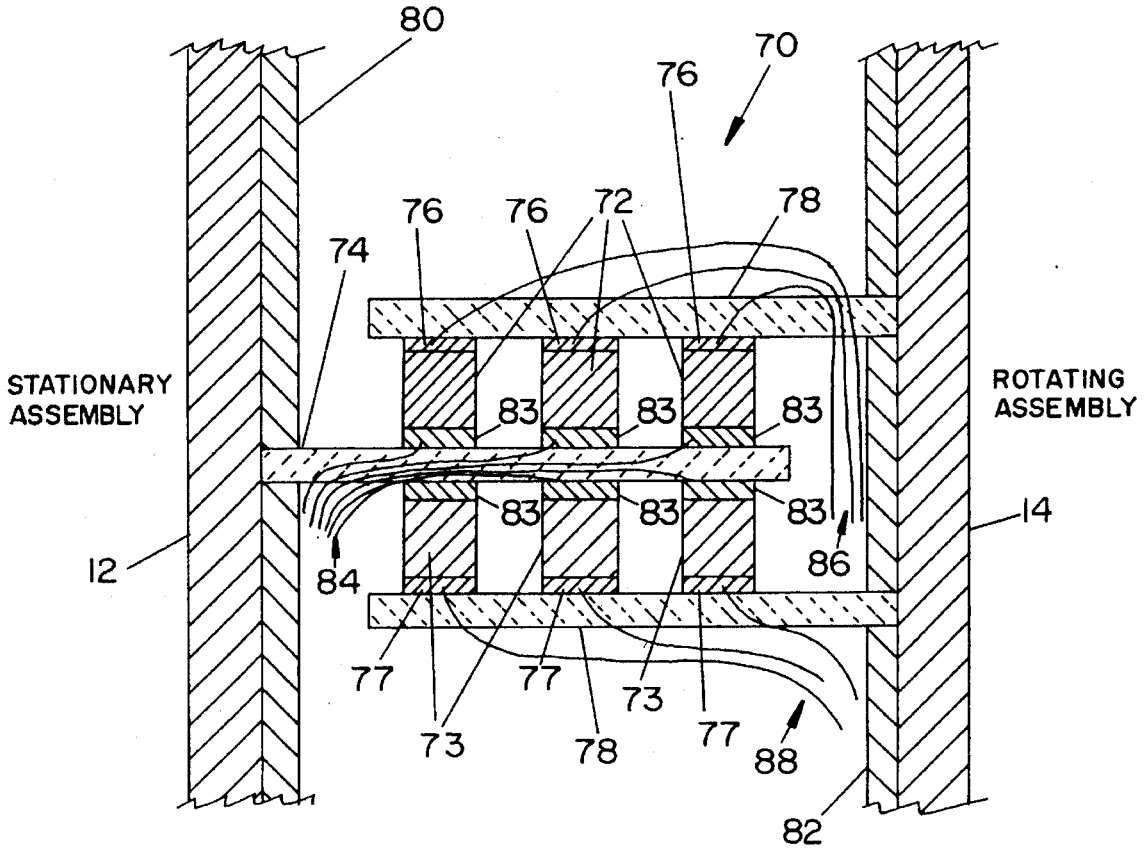
FIG. 2 is a cross section view of a portion of an electrical coupling for a rotating joint of the preferred embodiment of the invention.

FIG. 2 is a cross section view of a single module 70 of an electrical coupling assembly similar to electrical coupling assembly 34 shown in FIG. 1. Module 70 essential includes six wiper contacts 72 and 73 attached to stationary assembly 12 by means of insulating support 74 and conductive bands 76 and 77 formed upon annular surfaces 78 which are attached to rotating assembly 14.

Of course, the specific number of wiper contacts and conductive bands in a module is a matter of design choice and the particular application. Wiper contacts 72 and 73 shown are only two groups of several which are located around stationary assembly 12, and, as shown in FIG. 1, several of such groups are typically stacked together to furnish as many circuits as are required. Insulating supports 74 are attached to stationary assembly 12 by the use of support fixtures 80.

Conductive bands 76 and 77 are, of course, continuous on annular surfaces 78 all the way around rotating assembly 14, and are held in place by support fixtures 82 which are attached to both rotating assembly 14 and annular surfaces 78.

Wiper contacts 72 and 73 are constructed of materials well known in the art for use in such applications, for instance silver-graphalloy. Conductive bands 76 are constructed by a technique which is well known in the art of making printed circuits. In that method, boards constructed of a layer of electrical insulating material sandwiched between two layers of conductive material are treated, usually by etching, to remove portions of the metal layers to form concentric circular conductive bands 76 and 77 against which wiper contacts 72 and 73 are held.

A particularly convenient method of attaching wiper contacts 72 and 73 to stationary assembly 12 also uses the same etched board technique. By this method, support 74 is formed, like annular surfaces 78, of an insulating board sandwiched between conductive layers, and concentric rings 83 are formed upon support 74 in the same manner as conductive bands 76 and 77. Wiper contacts 72 and 73 are then simply soldered to concentric bands 83 on both sides of support 74.

Each group of wiper contacts 72 or 73 is located in a single plane, and each group of conductive bands is also located in a single plane which is parallel to the plane of the associated wiper contacts. Therefore, the points of contact between the several wiper contacts 72 and 73 and their conductive bands 76 and 77 are also in a single plane, and as rotating assembly 14 rotates, wiper contacts 72 always remain in contact with conductive bands 76, and wiper contacts 73 always remain in contact with conductive bands 77. This contact is mechanically maintained by the compression structure of supports 35 and springs 33 shown in FIG. 1.

Connecting wires 84 are connected to wiper contacts 72 and 73, through conductive bands 83 to which the wiper contacts are soldered and are used to conduct electrical current from the wiper contacts to any electrical devices associated with stationary assembly 12. Similarly, connecting wires 86 and 88 are associated with rotating assembly 14 and are used to connect conducting bands 76 and 77 to electrical devices on the rotating structure with which rotating assembly 14 is associated.

The present invention therefore is capable of transferring a very large number of of electrical current paths across a rotating joint, because unlike previous devices it makes use of not only the axial dimension of the rotating joint, but also adds multiple current transfer paths in the planes oriented transverse to the axis of the rotating joint.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For instance, the wiper contacts may be attached to the rotating assembly and the conductive bands may be attached to the stationary assembly, and the number of concentric conducting bands may be varied.

What is claimed as new and for which Letters patent of the United States are desired to be secured is:

1. A rotating joint for water and electrical connections comprising:

a first assembly including a cylindrical water pipe with an inner wall and an outer wall;

a second assembly located concentric with and outside the outer wall of the cylindrical water pipe and capable of rotational motion relative to the first assembly, a portion of the second assembly being spaced from the outer wall of the first assembly to form an annular space around the first assembly;

at least two parallel annular planar surfaces within the annular space, attached to one of the assemblies, with each planar surface including at least two continuous circular conductive bands which are concentric to the cylindrical pipe;

connecting means attached to at least two of the conductive bands to provide an electrical current connection with the conductive bands;

at least two support structures located in different planes attached to the other assembly;

wiper contacts attached to the support structures and located so that each wiper contact rests upon a conductive band regardless of the rotational orientation between the first assembly and the second assembly; and connecting means attached to at least two wiper contacts to provide an electrical current connection with the wiper contacts.

2. The rotating joint of claim 1 wherein the annular planar surfaces are electrical insulating material and the conductive bands are bonded to the annular planar surfaces.

3. The rotating joint of claim 1 wherein the conductive bands are copper.

4. A rotating joint for water and electrical connections comprising:

a first assembly including a cylindrical water pipe with an inner wall and an outer wall;

a second assembly located concentric with and outside the outer wall of the cylindrical water pipe and capable of rotational motion relative to the first assembly, a portion of the second assembly being spaced from the outer wall of the first assembly to form an annular space around the first assembly;

at least one annular planar surface within the annular space, attached to the first assembly, and including at least two continuous circular conductive bands which are concentric to the cylindrical pipe;

connecting means attached to at least two of the conductive bands to provide an electrical current connection with the conductive bands;

a support structure attached to the second assembly; at least two wiper contacts attached to the support structure and located so that each wiper contact rests upon a conductive band regardless of the rotational orientation between the first assembly and the second assembly;

connecting means attached to at least two wiper contacts to provide an electrical current connection with the wiper contacts; and a material located within the annular space to protect the conductive bands and wiper contacts from deterioration.

5. A rotating joint for water and electrical connections comprising:

a first assembly including a cylindrical water pipe with an inner wall and an outer wall;

a second assembly located concentric with and outside the outer wall of the cylindrical water pipe and capable of rotational motion relative to the first assembly, a portion of the second assembly being spaced from the outer wall of the first assembly to form an annular space around the first assembly;

at least one annular planar surface within the annular space, attached to the first assembly, and including at least two continuous circular conductive bands which are concentric to the cylindrical pipe;

connecting means attached to at least two of the conductive band regardless of the rotational orientation between the first assembly and the second assembly;

connecting means attached to at least two wiper contacts to provide an electrical current connection with the wiper contacts; and means to seal the annular space so that the annular space does not leak when containing a fluid and also including a fluid located within the annular space to protect the conductive bands and wiper contacts from deterioration.

* * * * *